US008205582B2

(12) United States Patent
Adams

(10) Patent No.: US 8,205,582 B2
(45) Date of Patent: Jun. 26, 2012

(54) EXHAUST CHECK VALVE AND PISTON RETURN SYSTEM

(75) Inventor: Joseph S. Adams, Salt Spring Island (CA)

(73) Assignee: Illinois Tool Works Inc., Glenview, IL (US)

( * ) Notice: Subject to any disclaimer, the term of this patent is extended or adjusted under 35 U.S.C. 154(b) by 802 days.

(21) Appl. No.: 12/073,139

(22) Filed: Feb. 29, 2008

(65) Prior Publication Data

US 2008/0237295 A1 Oct. 2, 2008

Related U.S. Application Data

(60) Provisional application No. 60/896,957, filed on Mar. 26, 2007.

(51) Int. Cl.
*F02B 71/00* (2006.01)

(52) U.S. Cl. ..... 123/46 SC; 123/46 R

(58) Field of Classification Search ..... 123/46 R, 123/46 SC, 46 A, 46 B, 46 H; 60/595
See application file for complete search history.

(56) References Cited

U.S. PATENT DOCUMENTS 4,365,471 A 12/1982 Adams
4,510,748 A 4/1985 Adams
4,665,868 A 5/1987 Adams
4,759,318 A 7/1988 Adams
4,821,683 A 4/1989 Veldman
4,905,634 A 3/1990 Veldman
5,213,247 A 5/1993 Gschwend et al.
5,752,643 A 5/1998 MacVicar et al.
6,116,489 A 9/2000 Branston
6,491,002 B1 * 12/2002 Adams ..... 123/46 R
6,840,033 B2 1/2005 Adams
6,912,988 B2 7/2005 Adams
6,932,031 B2 * 8/2005 Adams ..... 123/46 R
7,634,979 B2 * 12/2009 Adams ..... 123/46 R
2001/0006045 A1 7/2001 Thieleke et al.
2006/0065219 A1 3/2006 Hertlein et al.

* cited by examiner

*Primary Examiner* — M. McMahon
(74) *Attorney, Agent, or Firm* — Law Offices of Steven W. Weinrieb

(57) ABSTRACT

An exhaust check valve and piston return system wherein a main exhaust valve is opened as a result of combustion products from the combustion chamber being routed through a signal line. In addition, as a result of the opening of the main exhaust valve, an exhaust check valve, incorporated within a side wall portion of the cylinder housing at a location disposed downstream of the main exhaust valve, as considered in the direction of flow of the exhaust gases out from the combustion chamber, is forced to its open position so as to permit the combustion gases to be exhausted from the combustion chamber, thereby permitting the piston to move upwardly so as to complete its return stroke.

20 Claims, 11 Drawing Sheets

EXHAUST CHECK VALVE AND PISTON RETURN SYSTEM

CROSS-REFERENCE TO RELATED PATENT APPLICATION

This patent application is related to, based upon, and effectively a utility patent application conversion from U.S. Provisional Patent Application Ser. No. 60/896,957, which was filed on Mar. 26, 2007, the filing date benefits of which are hereby incorporated by reference.

FIELD OF THE INVENTION

The present invention relates generally to combustion-powered fastener-driving tools, and more particularly to a new and improved exhaust check valve and piston return system wherein a main exhaust valve is disposed within the upper wall portion of the combustion chamber, and an exhaust check valve is incorporated within a side wall portion of the cylinder housing at a location disposed above the combustion chamber such that when the main exhaust valve is opened so as to exhaust the hot combustion gases within the combustion chamber, the exhaust check valve will effectively be forced to its open position so as to permit the hot combustion gases to in fact be exhausted, thereby permitting the piston to move upwardly so as to in fact complete its return stroke and effectively prevent the occurrence of piston bounce.

BACKGROUND OF THE INVENTION

Conventional combustion-powered fastener-driving tools normally rely upon the vacuum or reduced pressure conditions, effectively formed within the combustion chamber as a result of the residual combustion gases within the combustion chamber undergoing cooling after the piston has been driven downwardly by the forces generated within the combustion chamber so as to drive a fastener into a substrate, to effectuate the return of the piston back to its original or uppermost position. More particularly, this occurs in view of the fact that such conventional tools normally utilize a plurality of exhaust ports which are disposed in a predetermined array defined within lower side wall portions of the cylinder housing at positions which will be adjacent to the piston when the piston reaches the end of its down stroke or power stroke so as to be disposed at its lowermost position and thereby drive a fastener into a substrate. It can therefore be appreciated that the exhaust ports will be disposed beneath the piston as the piston begins its down stroke or power stroke, however, when the piston reaches the end of its down stroke or power stroke and is disposed at its lowermost position, the piston will effectively pass below the array of exhaust ports such that the combustion chamber is now fluidically connected to the exhaust ports whereby the exhaust gases within the combustion chamber can be discharged or exhausted outwardly to atmosphere from the combustion chamber and the tool. Accordingly, the mass of the gases remaining in the combustion chamber is reduced, such gases will subsequently be cooled and effectively condensed, and the subsequent drop in pressure, relative to the ambient pressure upon the underside of the piston, effectively results in the formation of vacuum or reduced pressure conditions within the combustion chamber above the piston, thereby effectively drawing the piston back to its original or uppermost position.

The problem with such a system is that when the piston reaches the end of its down stroke or power stroke so as to be disposed at its lowermost position, the piston will normally encounter a bumper which effectively controls the deceleration and travel length of the piston. Accordingly, the piston will effectively bounce off or back from the bumper thereby covering or closing off the exhaust ports before a sufficient amount of the combustion gases, disposed within the combustion chamber, can be exhausted to atmosphere. The piston, now moving in the upward direction, therefore compresses the combustion gases which are disposed above it and effectively trapped within the combustion chamber until the upward movement or energy of the piston is effectively dissipated or exhausted as a result of such gas compression. In addition, the compressed gases will subsequently expand and tend to move the piston back downwardly so as to effectively return the piston toward its lowermost position. This phenomenon can cause a double strike which might tend to partially drive another fastener out from the tool. Alternatively, the piston can oscillate for a number of cycles causing fresh or ambient air, disposed beneath the piston, to effectively short circuit around the piston, by means of the exhaust ports defined within the side wall portions of the cylinder housing, whereby the vacuum or low pressure conditions within the combustion chamber will effectively be reduced thereby causing the piston to be returned slowly to its original or uppermost position, or alternatively, the piston may only achieve a partial or incomplete return movement. Still further, since this process has effectively caused hot combustion gases to be maintained within the tool for an abnormally long period of time, the tool will be prone to overheating.

A need therefore exists in the art for an improved combustion gas exhaust and piston return system whereby the aforenoted problems will not occur within the combustion-powered fastener-driving tool.

SUMMARY OF THE INVENTION

The foregoing and other objectives are achieved in accordance with the teachings and principles of the present invention through the provision of a new and improved exhaust valve arrangement or system, for disposition within the combustion chamber of a combustion-powered fastener-driving tool, which eliminates the aforenoted exhaust port system defined within the lower end side wall portions of the cylinder housing and effectively replaces the same with a main exhaust valve disposed within the upper end portion of the combustion chamber. In addition, an exhaust check valve is disposed within an upper end portion of the cylinder housing so as to be disposed above the combustion chamber. Still further, a vent port is defined within the lower end wall member of the cylinder housing so as to permit the air, disposed beneath the piston, to be vented when the piston is moved downwardly during its down stroke or power stroke, and a signal line also fluidically connects a lower side wall portion of the cylinder housing to the main exhaust valve. Accordingly, when the piston approaches or reaches its lowermost position and passes the port by means of which the signal line is connected to the cylinder housing, the signal line is fluidically connected to the combustion chamber such that the combustion gases will be exhausted from the combustion chamber, conducted through the signal line, and actuate the main exhaust valve to its open position.

Therefore, as the piston is moved upwardly during its return stroke, the residual gases disposed within the combustion chamber will be forced outwardly from the combustion chamber as a result of being exhausted through the main exhaust valve, and in addition, such exhaust gases will force the exhaust check valve to its open position. Therefore, the exhaust gases disposed within the combustion chamber are not trapped, the piston does not compress any exhaust gases within the combustion chamber, and the exhaust gases within the combustion chamber are rapidly exhausted to atmosphere so as to minimize heat buildup within the tool. In accordance with further embodiments of the exhaust valve and piston return system, air disposed beneath the piston can be stored within a plenum chamber which can be subsequently used to assist the upward movement of the piston to its original or uppermost position, or still further, the air from the plenum chamber can be conducted back into the combustion chamber so as to be used to scavenge the exhaust gases from the combustion chamber or to provide fresh air to be mixed with fuel injected into the combustion chamber so as to form the desired air-fuel mixture.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
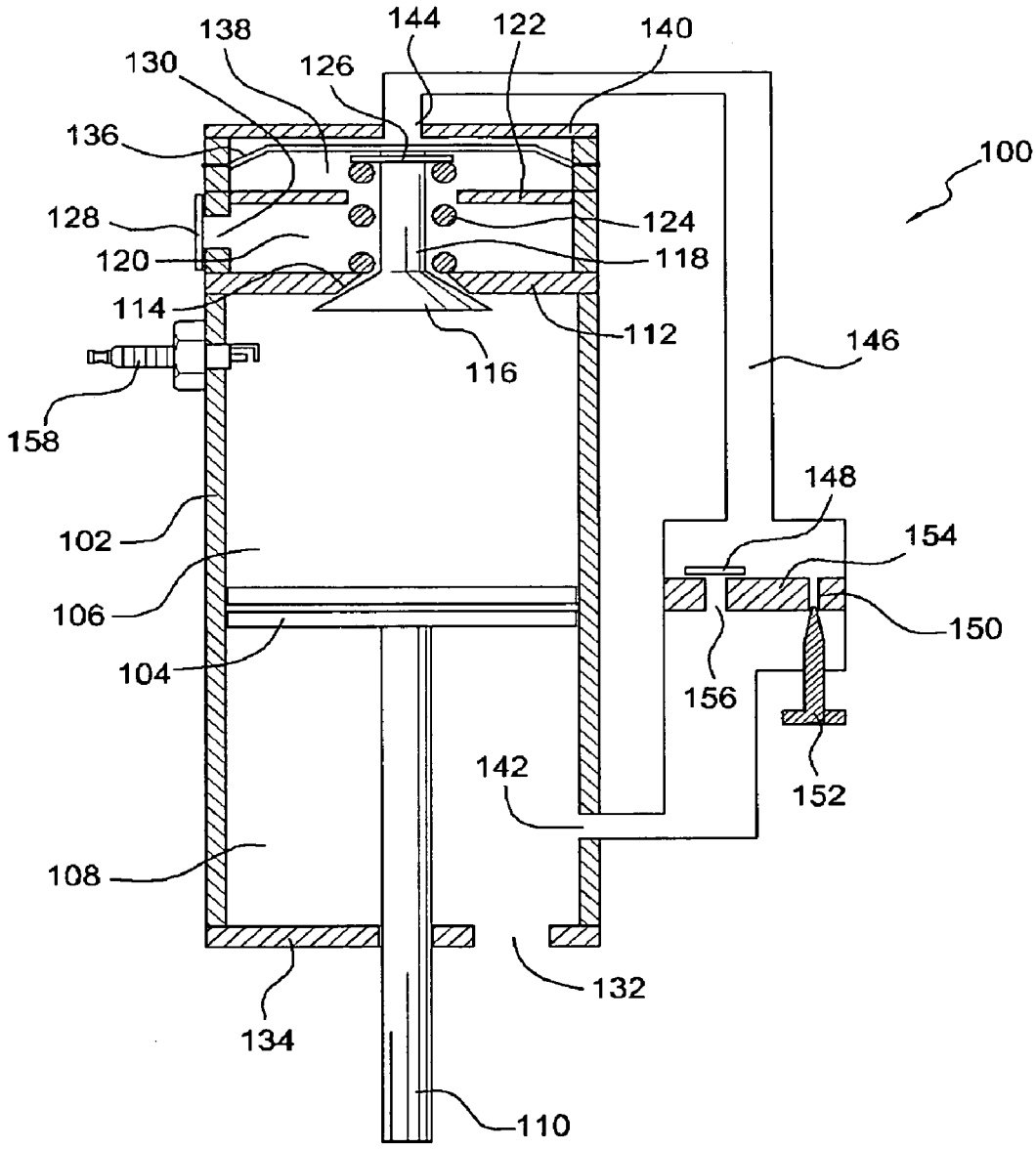
FIG. 1 is a schematic view of a first embodiment of a new and improved exhaust check valve and piston return system as constructed in accordance with the principles and teachings of the present invention and showing the cooperative components thereof at the beginning of a combustion cycle.

Referring now to the drawings, and more particularly to FIGS. 1-6 thereof, a first embodiment of a new and improved exhaust check valve and piston return system, for use, for example, in connection with the combustion chamber of a fastener-driving tool, is disclosed and is generally indicated by the reference character 100. More particularly, it is seen that the new and improved exhaust check valve and piston return system, for use in connection with the combustion chamber of a fastener-driving tool, comprises a cylinder housing 102 which has a piston 104 movably disposed therein so as to effectively divide the interior space of the cylinder housing 102 into an upper combustion chamber 106 and a lower working chamber 108. The piston 104 also has a piston rod or driver member 110 fixedly attached thereto for engaging a fastener in order to drive the fastener out from the fastener-driving tool when the piston 104 is moved downwardly during its down stroke or power stroke as effected by means of combustion of an air-fuel mixture within the combustion chamber 106. The upper end portion of the combustion chamber 106 is defined by means of a first upper end wall member 112, wherein a central portion of the first upper end wall member 112 is provided with an opening 114 which effectively serves as a valve seat for a main exhaust valve 116. A stem 118 of the main exhaust valve 116 extends upwardly through an exhaust chamber 120 which is defined within the cylinder housing 102 by means of the first upper end wall member 112 and a second upper end wall member 122. A coil spring member 124 is disposed around the main exhaust valve stem 118, and the upper end portion of the main exhaust valve stem 118 is provided with a transversely oriented spring retention member 126 such that the upper end portion of the coil spring member 124 is engaged with the spring retention member 126 while the lower end portion of the coil spring member 124 is seated atop the first upper end wall member 112. In this manner, the coil spring member 124 normally biases the main exhaust valve 116 to its closed or seated position with respect to the valve seat 114.

Continuing further, an exhaust check valve 128 is operatively associated with an exhaust port 130 which is defined within a side wall member of the exhaust chamber 120, and an ambient air or working air vent port 132 is defined within the lower end wall member 134 of the cylinder housing 102 so as to permit the ambient air or working air, disposed beneath the piston 104, to be vented from the working chamber 108 when the piston 104 is moved downwardly during its downward stroke or power stroke. In addition, a diaphragm member 136 is disposed within a signal chamber 138, which is defined within the upper end portion of the cylinder housing 102 between the second upper end wall member 122 and the upper end wall member 140 of the cylinder housing 102, so as to effectively be engaged with the upper end portion of the valve stem 118, and a first signal port 142 is defined within a lower side wall portion of the working chamber 108, while a second signal port 144 is defined within the upper end wall member 140 of the cylinder housing 102. Still yet further, a signal line 146 fluidically connects the first signal port 142 to the second signal port 144, and it is seen that a check valve 148 and an orifice 150 are disposed within the signal line 146. A suitable adjuster mechanism 152 is operatively associated with the orifice 150 in order to adjust the actual opening of the orifice 150, and it is seen that the adjuster mechanism 152 is defined within a suitable wall member 154, as is a check valve port 156 which is opened and closed by means of the check valve 148.

Figure 2:
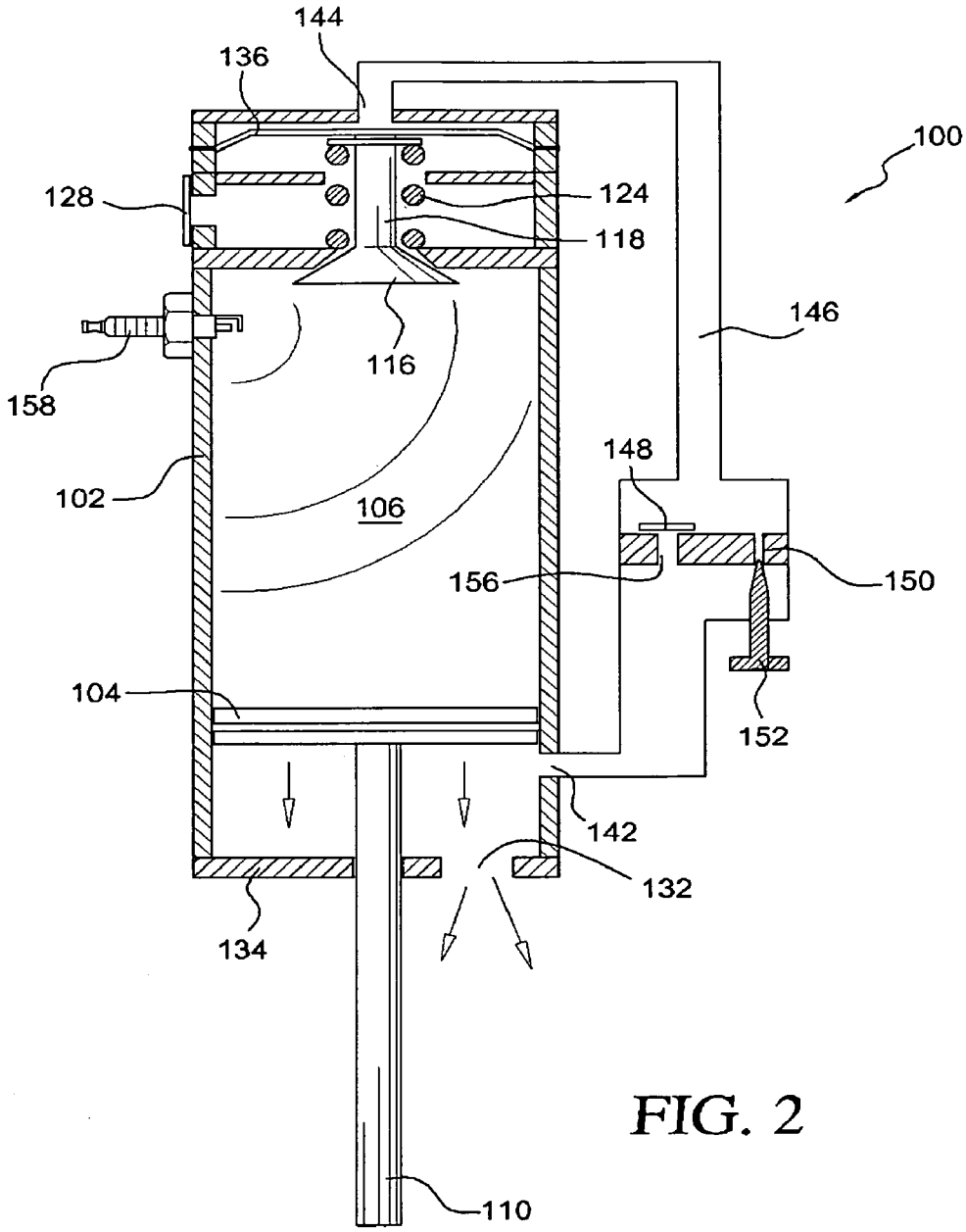
FIG. 2 is a schematic view of the first embodiment exhaust check valve and piston return system, as disclosed within FIG. 1 showing, however, the initiation of a combustion cycle wherein the piston has begun its down stroke or power stroke in order to begin driving a fastener out of the tool and into a substrate, and wherein the air disposed beneath the piston has been vented to atmosphere.
Figure 3:
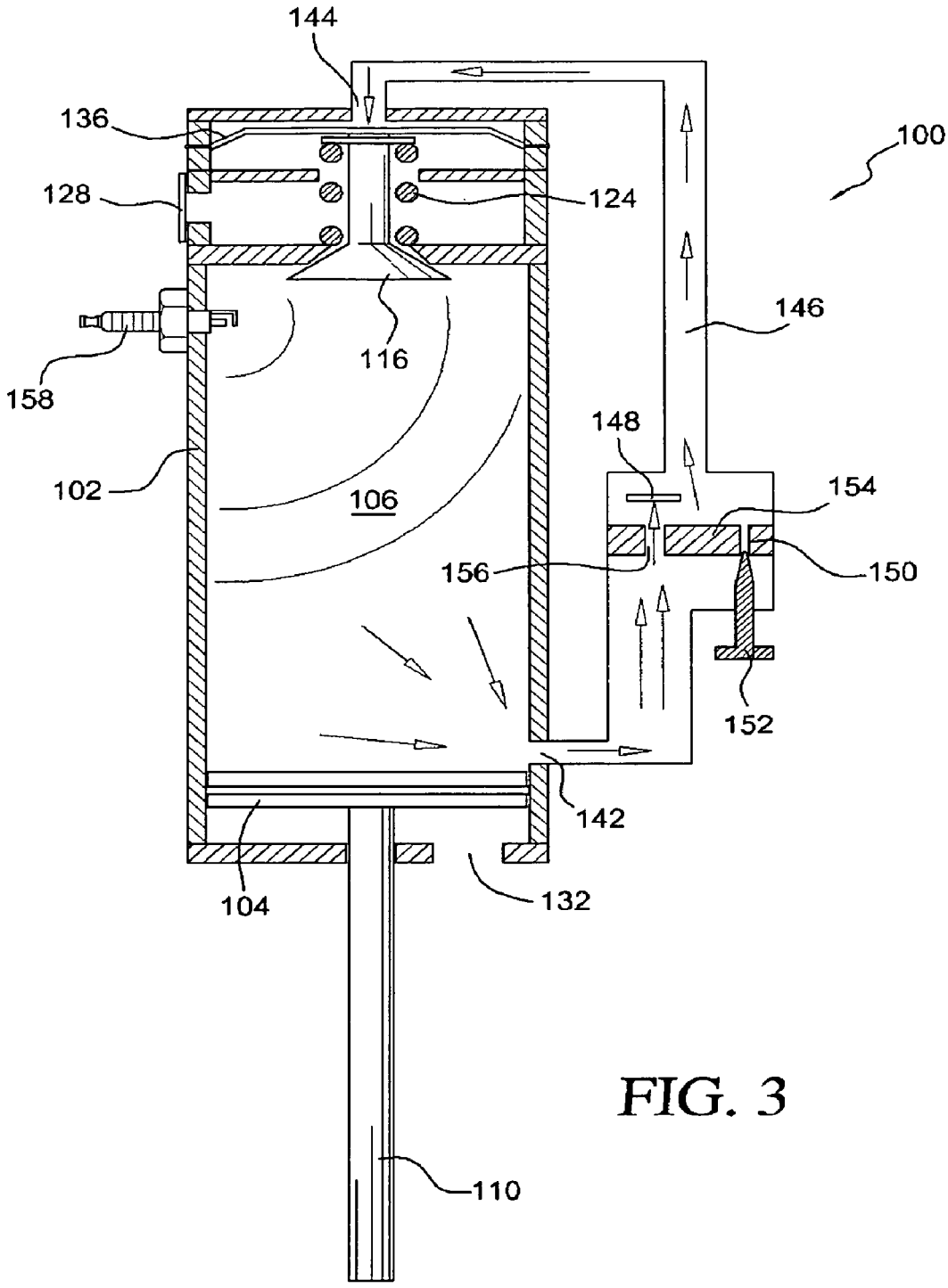
FIG. 3 is a schematic view of the first embodiment exhaust check valve and piston return system, as disclosed within FIGS. 1 and 2, wherein the piston has reached the bottom or end position of its down stroke or power stroke whereby a signal line, interconnecting a lower end side wall portion of the cylinder housing to the main exhaust valve, is uncovered so as to fluidically connect the combustion chamber to the main exhaust valve.
Figure 4:
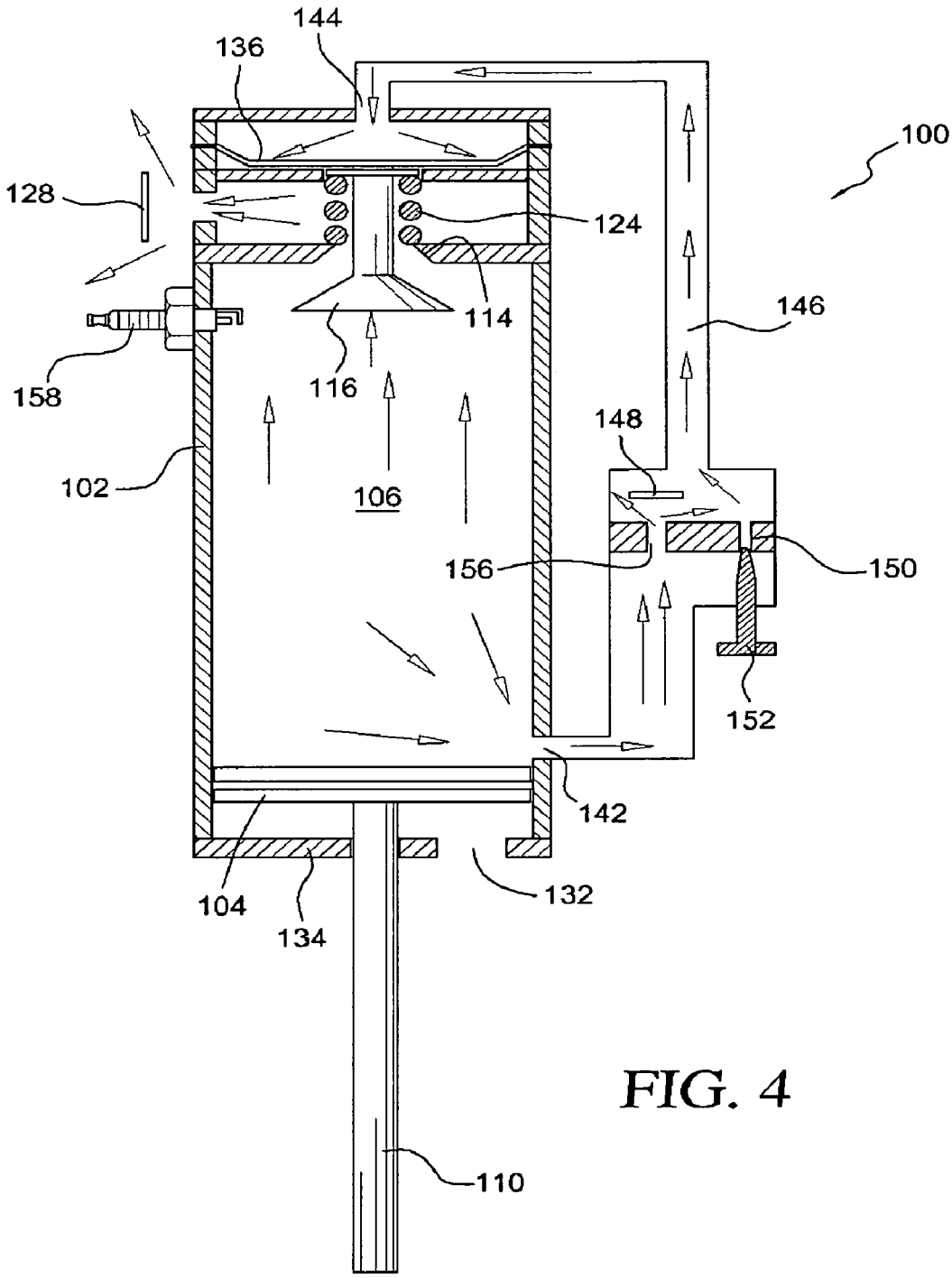
FIG. 4 is a schematic view of the first embodiment exhaust check valve and piston return system, as disclosed within FIG. 3, wherein the combustion gases, disposed within the combustion chamber, have now opened the main exhaust valve, as a result of having been conducted to the main exhaust valve by means of the signal line, whereby combustion gases disposed within the combustion chamber can now be exhausted from the combustion chamber through the main exhaust valve and the exhaust check valve disposed within an upper end side wall portion of the cylinder housing disposed above the combustion chamber.

In operation, when a fastener-driving cycle or operation is to be initiated, an air-fuel mixture, disposed within the combustion chamber 106, is ignited by means of an ignition device, such as, for example, a spark plug 158, causing the piston 104 to be driven downwardly, as shown in FIG. 2, whereby the air disposed beneath the piston 104 will be vented to atmosphere through means of the vent port 132. Continuing further, as can best be appreciated from FIG. 3, when the piston 104 effectively reaches the end of its down stroke or power stroke and is disposed at its lowermost position within the cylinder housing 102, the piston 104 will be disposed beneath the first signal port 142 whereby the combustion chamber 106 will now be fluidically connected to the first signal port 142 and the signal line 146. The combustion gases, disposed within the combustion chamber 106, will then pass through the first signal port 142, enter the lower end portion of the signal line 146, pass through the check valve port 156 so as to open the check valve 148, flow through the upper end portion of the signal line 146, and act upon the diaphragm member 136 with a sufficient amount of pressure so as to force the main exhaust valve 116 to a downward open position, against the biasing force of the coil spring 124, as disclosed within FIG. 4. Accordingly, the exhaust gases disposed within the combustion chamber 106 can now be exhausted out through the open main exhaust valve 116 whereby the pressure of such exhaust gases forces the exhaust check valve 128 to its open position so that the exhaust gases are exhausted to atmosphere.

Figure 5:
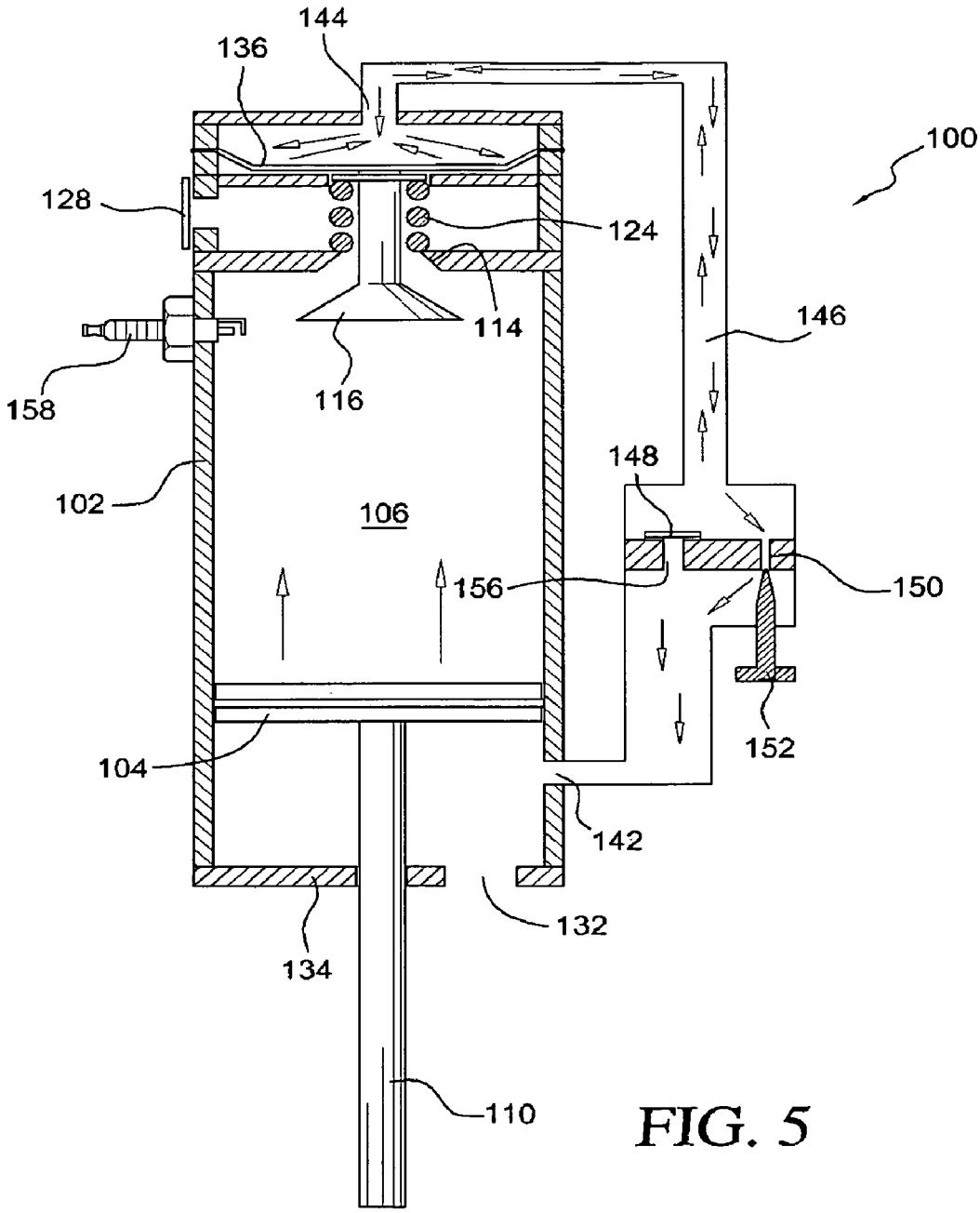
FIG. 5 is a schematic view of the first embodiment exhaust check valve and piston return system, as disclosed within FIG. 4, wherein the combustion gases disposed within the combustion chamber have now begun to cool thereby effectively creating a vacuum or reduced pressure conditions within the combustion chamber so as to cause the piston to be drawn upwardly back to its original or start position, the exhaust check valve has been drawn back to its closed position, and the main exhaust valve begins to close, as a result of the spring bias operatively associated therewith, so as to cause the air disposed above the main exhaust valve to be bled back through the signal line and into the chamber disposed beneath the piston in order to assist the upward movement or return stroke of the piston.
Figure 6:
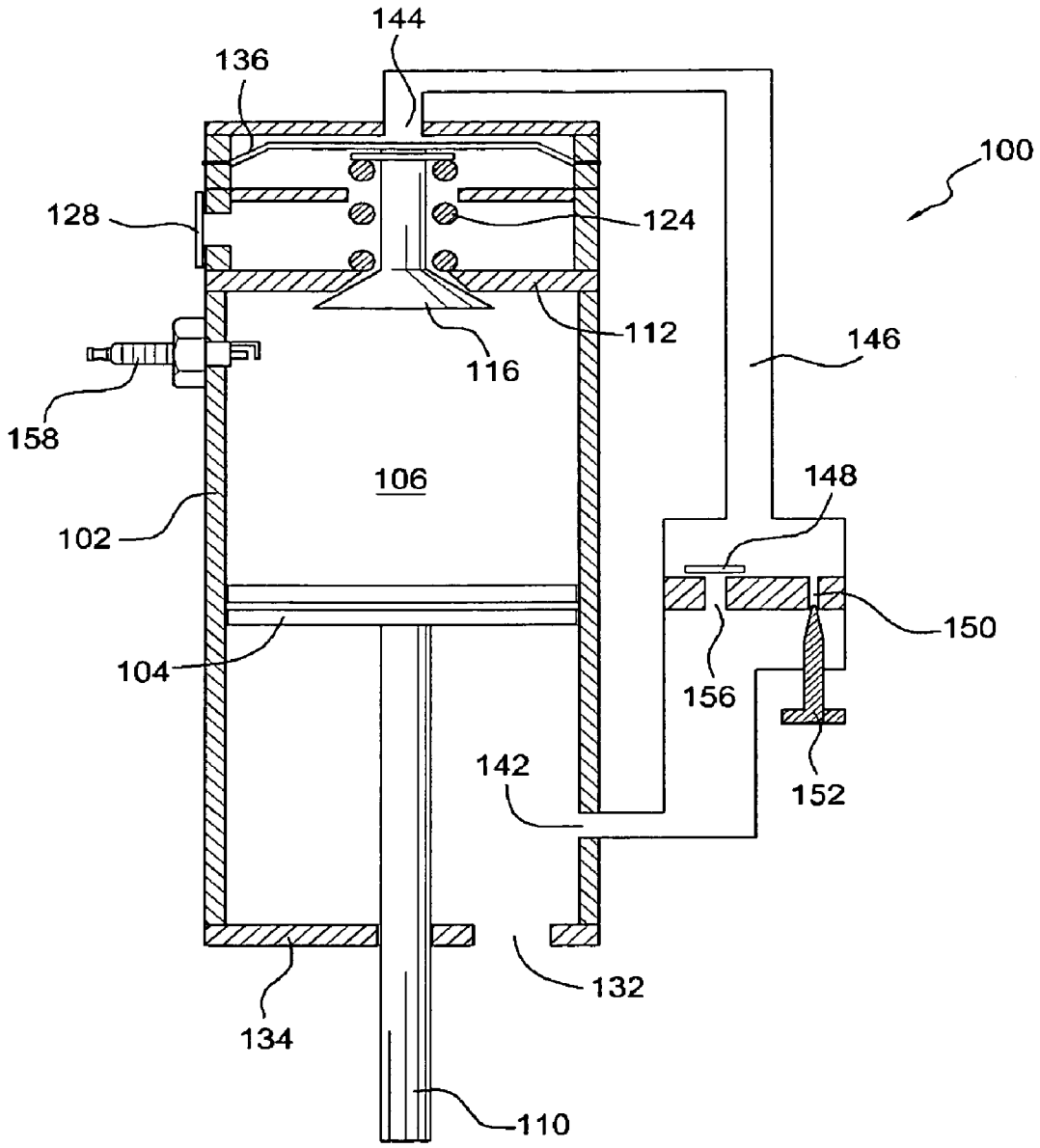
FIG. 6 is a schematic view of the first embodiment exhaust check valve and piston return system, which is substantially the same as FIG. 1, in that the piston has now been fully returned to its original or start position in preparation for a new combustion cycle whereby the piston will be driven downwardly in order to drive another fastener outwardly from the tool and into a substrate.

Continuing further, and with particular reference being additionally particularly made to FIG. 5, as the combustion gases are exhausted from the combustion chamber 106, the mass of combustion gases remaining within the combustion chamber 106 is significantly diminished, such residual exhaust gases remaining within the combustion chamber 106 begin to cool and condense, and a vacuum or substantially reduced pressure conditions are developed within the combustion chamber 106. Accordingly, such vacuum or reduced pressure conditions within the combustion chamber 106 causes the exhaust check valve 128 to be moved to its closed position, and also causes the piston 104 to begin to move upwardly within the cylinder housing 102 so as to return to its original or start position. As a result of such upward movement of the piston 104 within the cylinder housing 102, the check valve 148, disposed within the signal line 146, moves to its closed position, and since no further significant pressure from the signal line 146 is acting upon the diaphragm 136, the previously compressed coil spring member 124 begins to expand and move the main exhaust valve 116 and the diaphragm 136 in the upward direction thereby causing the air, disposed within the signal line 146, to now flow in the opposite direction from the second signal port 144 toward the first signal port 142. Since the check valve 148, disposed within the signal line 146 is closed, however, the air flow within the signal line 146 must pass or bleed through the orifice 150. The flow of air through the orifice 150 is controlled by means of the adjuster mechanism 152, and in this manner, the disposition of the adjuster mechanism 152, with respect to the orifice 150, will effectively control the time it takes for the coil spring member 124 to completely re-seat the main exhaust valve 116 upon its valve seat 114. Ultimately, the main exhaust valve 116 will be re-seated upon its valve seat 114, and the piston 104 will have returned to its original or start position, as illustrated within FIG. 6, which is essentially the same as FIG. 1, whereby the tool is now ready for another fastener-driving operational cycle.

Figure 7:
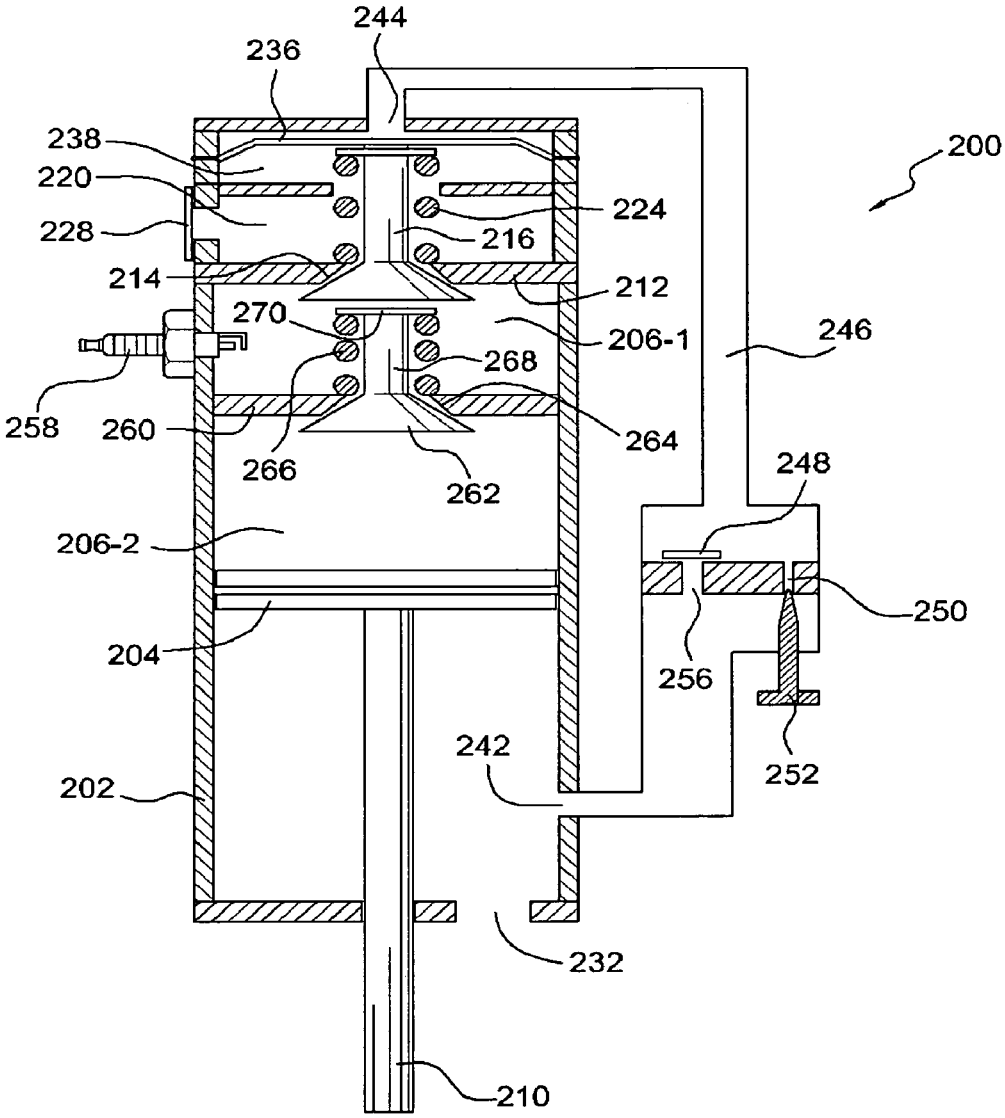
FIG. 7 is a schematic view of a second embodiment exhaust check valve and piston return system wherein it is seen that the combustion chamber has effectively been divided into two combustion chambers, a control valve is interposed between the two combustion chambers so as to fluidically connect the combustion chambers together and thereby permit combustion to effectively propagate from the first combustion chamber into the second combustion chamber after combustion has been initiated within the first combustion chamber, and a main exhaust valve is operatively associated with the first combustion chamber so as to permit the exhaust of the combustion gases from both combustion chambers to be exhausted out through the exhaust check valve.
Figure 8:
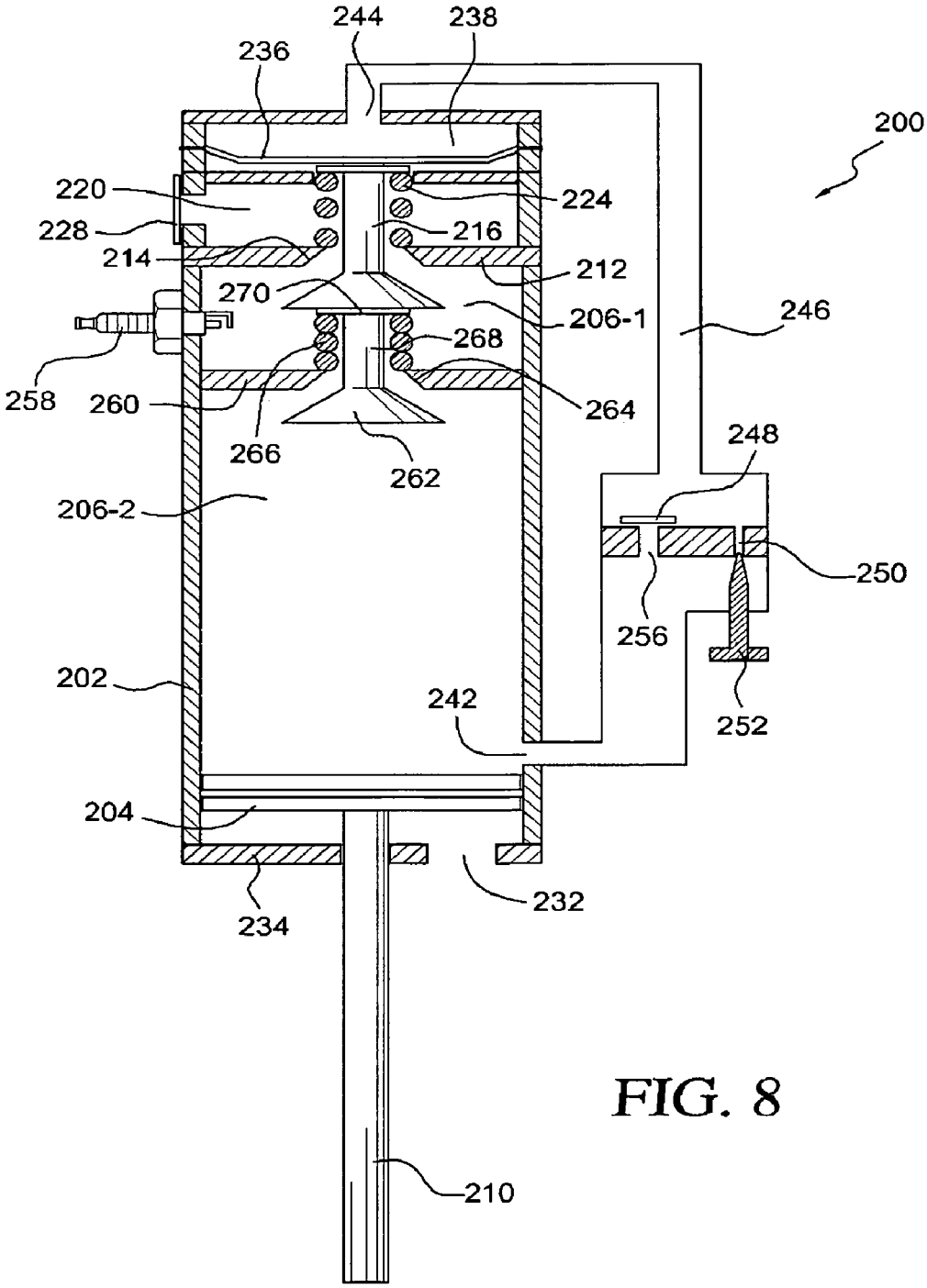
FIG. 8 is a schematic view of the second embodiment exhaust check valve and piston return system, as disclosed within FIG. 7, wherein the main exhaust valve has been moved to its open position so as to permit the combustion gases disposed within the combustion chambers to be exhausted to atmosphere through means of the exhaust check valve.

With reference now being made to FIGS. 7 and 8, a second embodiment of a new and improved exhaust check valve and piston return system, for use, for example, in connection with the combustion chamber of a fastener-driving tool, is disclosed and is generally indicated by the reference character 200. In view of the basic similarities of the second embodiment exhaust check valve and piston return system 200, with respect to the first embodiment exhaust check valve and piston return system 100 as disclosed within FIGS. 1-6, a detailed description of the entire second embodiment exhaust check valve and piston return system 200 will be omitted herefrom for brevity purposes, and in lieu thereof, the description of the second embodiment exhaust check valve and piston return system 200 will focus upon the differences between the first and second embodiments of the exhaust check valve and piston return systems 100,200. In addition, it is to be noted that component parts of the second embodiment exhaust check valve and piston return system 200, which correspond to components parts of the first embodiment exhaust check valve and piston return system 100, will be designated by corresponding reference characters except that they will be within the 200 series.

More particularly, the primary significant difference between the first and second embodiments of the exhaust check valve and piston return systems 100,200 resides in the fact that in accordance with the principles and teachings of the second embodiment exhaust check valve and piston return system 200, a partition wall 260 has been disposed, in effect, within the original combustion chamber, as disclosed within the first embodiment exhaust check valve and piston return system 100, so as to effectively divide the original combustion chamber into two combustion chambers 206-1 and 206-2 wherein combustion chamber 206-1 is disposed above combustion chamber 206-2. The ignition device, such as, for example, a spark plug, 258 is disposed within a side wall portion of the upper combustion chamber 206-1, and a spring-biased control valve 262 is operatively associated with the partition wall 260 so as to control the flow or propagation of combustion from the first combustion chamber 206-1 into the second combustion chamber 206-2. The partition wall 260 has a centrally located opening 264 which effectively defines a valve seat for the control valve 262, and a coil spring member 266 is disposed around the upstanding valve stem 268 of the control valve 262. The upper end portion of the control valve stem 268 is provided with a transversely oriented spring retention member 270, and in this manner, the upper end portion of the coil spring member 266 is engaged with the spring retention member 270 while the lower end portion of the coil spring member 266 is seated atop the partition wall member 260 such that the coil spring member 266 normally biases the control valve 262 to its closed or seated position with respect to the valve seat 264.

By providing the partition wall member 260 so as to effectively divide the combustion chamber into the upper and lower combustion chambers 206-1,206-2, quicker combustion of the air-fuel mixture within the upper combustion chamber 206-1 can be achieved, as can enhanced pressures, all of which will cause the combustion flame fronts to rapidly propagate into the lower combustion chamber 206-2. Accordingly, when ignition of the air-fuel mixture within the upper combustion chamber 206-1 is initiated by means of the spark plug 258, the pressure and forces developed within the upper combustion chamber 206-1 will cause the control valve 262 to move downwardly and be unseated from its valve seat 264 whereby combustion will propagate into and continue within the lower combustion chamber 206-2. In this manner, the piston 204 will be moved downwardly, as was the case in the first embodiment exhaust check valve and piston return system 100, and when the piston effectively reaches the end of its down stroke or power stroke so as to be disposed at its lowermost position, as illustrated within FIG. 8, the piston 204 will be disposed beneath the first signal port 242 so as to effectively uncover the same whereby the combustion gases from both combustion chambers 206-1,206-2 will be conducted into the signal line 246. Accordingly, such combustion gases will exert pressure upon the diaphragm 236 whereby the main exhaust valve 216 will be unseated from its valve seat 214, and will actually engage the spring retention member 270 of the control valve 262 so as to maintain the control valve 262 at its unseated open position. Accordingly, the combustion gases, disposed within both combustion chambers 206-1,206-2, are now permitted to be exhausted through or past the control valve 262 and the main exhaust valve 216 so as to exert pressure upon the exhaust check valve 228 and thereby cause the same to be moved to its open position whereby the combustion gases can be exhausted to atmosphere.

As was the case with the first embodiment exhaust check valve and piston return system 100, as the combustion gases are exhausted from the combustion chambers 206-1,206-2, the mass of combustion gases remaining within the combustion chambers 206-1,206-2 is significantly diminished, such residual combustion gases remaining within the combustion chambers 206-1,206-2 begin to cool and condense, and vacuum or substantially reduced pressure conditions are developed within the combustion chambers 206-1,206-2. Accordingly, such vacuum or reduced pressure conditions within the combustion chambers 206-1,206-2 causes the exhaust check valve 228 to be moved to its closed position, and also causes the piston 204 to begin to move upwardly within the cylinder housing 202 so as to return to its original or start position. As a result of such upward movement of the piston 204 within the cylinder housing 202, the check valve 248, disposed within the signal line 246, moves to its closed position, and since no further significant pressure from the signal line 246 is acting upon the diaphragm 236, the previously compressed coil spring member 224 begins to expand and move the main exhaust valve 216 and the diaphragm 236 in the upward direction thereby causing the air, disposed within the signal line 246, to now flow in the opposite direction from the second signal port 244 toward the first signal port 242. Since the check valve 248, disposed within the signal line 246 is closed, however, the air flow within the signal line 246 must pass or bleed through the orifice 250. The flow of air through the orifice 250 is controlled by means of the adjuster mechanism 252, and in this manner, the disposition of the adjuster mechanism 252, with respect to the orifice 250, will effectively control the time it takes for the coil spring member 224 to completely re-seat the main exhaust valve 216 upon its valve seat 214. Ultimately, the main exhaust valve 216 will be re-seated upon its valve seat 214, and the piston 204 will have returned to its original or start position, whereby the tool is now ready for another fastener-driving operational cycle. It is also to be noted that as a result of the upward movement of the main exhaust valve 216 back toward its seated position with respect to the valve seat 214, the same is effectively disengaged from the control valve 262 whereby the biasing spring 266 will cause the control valve 262 to be returned to its closed or seated position upon the valve seat 264.

Figure 9:
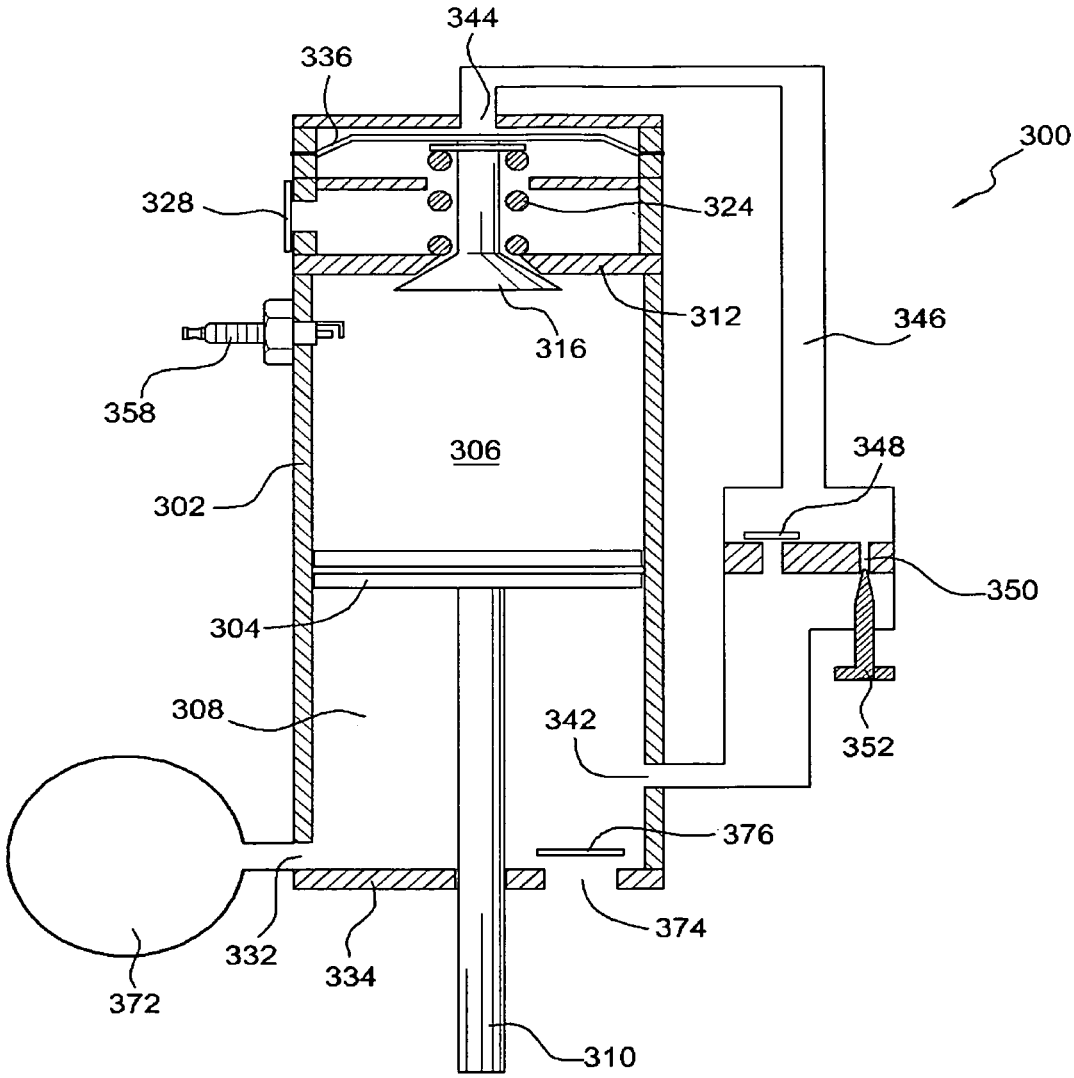
FIG. 9 is a schematic view of a third embodiment exhaust check valve and piston return system, similar to the first embodiment exhaust check valve and piston return system as disclosed within FIG. 1, wherein, however, in lieu of the air disposed beneath the piston being exhausted to atmosphere as the piston undergoes its downward stroke or power stroke, the air is accumulated within a storage plenum chamber so as to subsequently assist the upward return movement of the piston back to its original or start position.

With reference now being made to FIG. 9, a third embodiment of a new and improved exhaust check valve and piston return system, for use, for example, in connection with the combustion chamber of a fastener-driving tool, is disclosed and is generally indicated by the reference character 300. In view of the basic similarities of the third embodiment exhaust check valve and piston return system 300, with respect to the first embodiment exhaust check valve and piston return system 100 as disclosed within FIGS. 1-6, a detailed description of the entire third embodiment exhaust check valve and piston return system 300 will be omitted herefrom for brevity purposes, and in lieu thereof, the description of the third embodiment exhaust check valve and piston return system 300 will focus upon the differences between the first and third embodiments of the exhaust check valve and piston return systems 100,300. In addition, it is to be noted that component parts of the third embodiment exhaust check valve and piston return system 300, which correspond to components parts of the first embodiment exhaust check valve and piston return system 100, will be designated by corresponding reference characters except that they will be within the 300 series.

More particularly, it is seen that the primary significant differences between the first and third embodiments of the exhaust check valve and piston return systems 100,300 resides in the fact that in accordance with the principles and teachings of the third embodiment exhaust check valve and piston return system 300, the vent port within the lower end wall member of the cylinder housing has effectively been moved to a lower side wall portion of the cylinder housing 302 and is fluidically connected to a storage plenum chamber 372. In addition, an inlet port 374, having an inlet check valve 376 operatively associated therewith, is now located within the lower end wall member 334 of the cylinder housing 302. Accordingly, when the piston 304 is moving downwardly during its down stroke or power stroke, the air disposed beneath the piston 304 is prevented from being vented from the working chamber 308 in view of the presence of the inlet check valve 376 being closed. Therefore, the trapped air, disposed beneath the piston 304 is forced outwardly through the vent port 332 and into the storage plenum chamber 372 where it is effectively compressed so as to effectively form or define potential energy. When the piston 304 has therefore reached the end of its down stroke or power stroke and is disposed at its lowermost position such that the first signal port 342 is uncovered so as to initiate the exhaust process for the combustion gases disposed within the combustion chamber 306, whereby, as a result of the formation of vacuum or reduced pressure conditions within the combustion chamber 306, the piston 304 will begin its upward return stroke, the potential energy of the compressed air within the storage plenum chamber 372 will be released so as to assist the return movement of the piston 304 back to its original or start position. It is also to be noted that such return movement of the piston 304 is additionally assisted by means of fresh ambient air entering the working chamber 308 through means of the inlet check valve 376.

Figure 10:
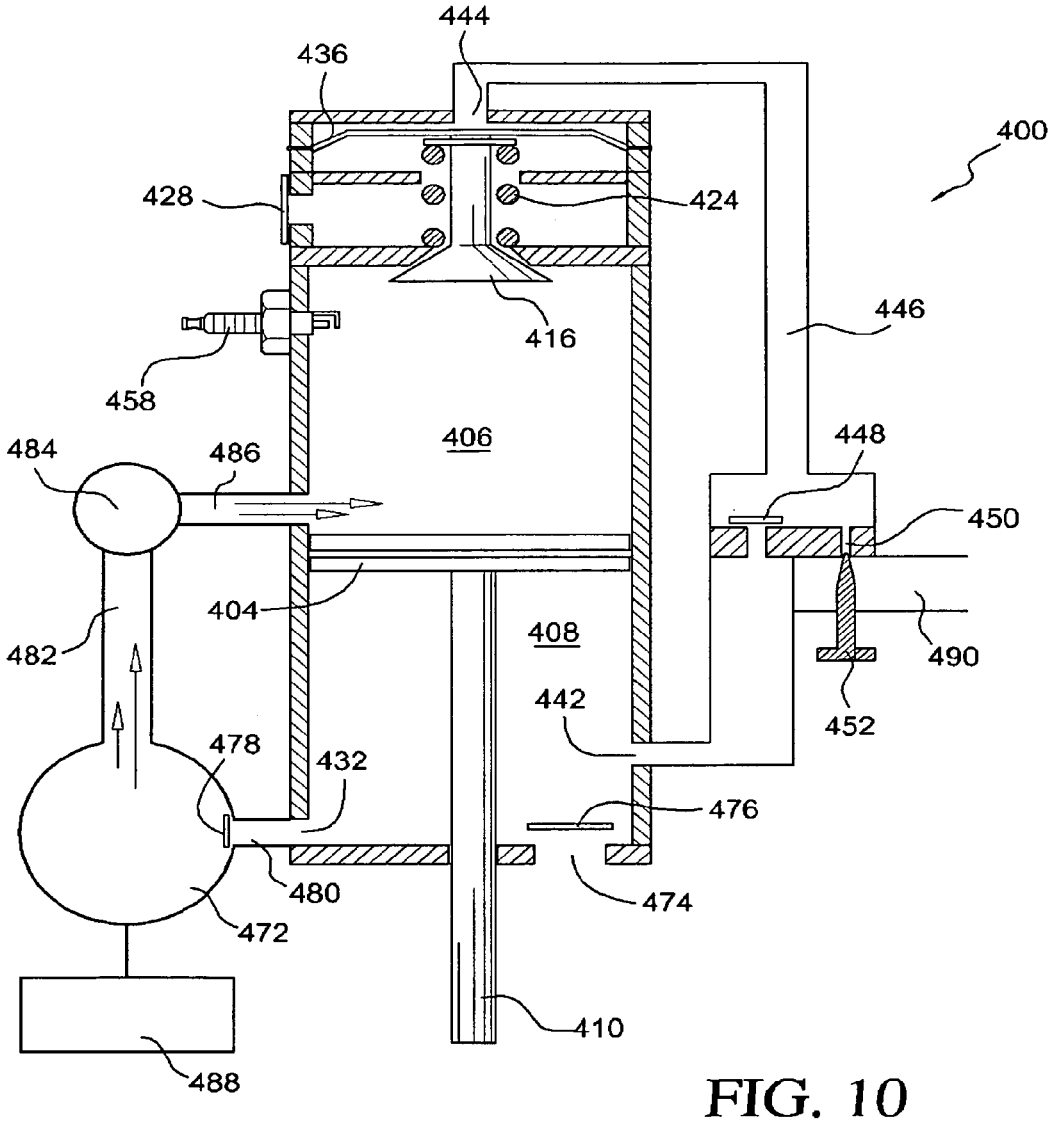
FIG. 10 is a schematic view of a fourth embodiment exhaust check valve and piston return system, similar to the third embodiment exhaust check valve and piston return system as disclosed within FIG. 9, wherein, however, in lieu of the air disposed within the storage plenum chamber being used to assist the upward return movement of the piston back to its original or start position, the air from the storage plenum chamber is conducted into the combustion chamber, by means of a conduit connecting the storage plenum chamber to the combustion chamber, for scavenging or air-fuel mixture purposes.

With reference now being made to FIG. 10, a fourth embodiment of a new and improved exhaust check valve and piston return system, for use, for example, in connection with the combustion chamber of a fastener-driving tool, is disclosed and is generally indicated by the reference character 400. In view of the basic similarities of the fourth embodiment exhaust check valve and piston return system 400, with respect to the third embodiment exhaust check valve and piston return system 300 as disclosed within FIG. 9, a detailed description of the entire fourth embodiment exhaust check valve and piston return system 400 will be omitted herefrom for brevity purposes, and in lieu thereof, the description of the fourth embodiment exhaust check valve and piston return system 400 will focus upon the differences between the third and fourth embodiments of the exhaust check valve and piston return systems 300,400. In addition, it is to be noted that component parts of the fourth embodiment exhaust check valve and piston return system 400, which correspond to components parts of the third embodiment exhaust check valve and piston return system 300, will be designated by corresponding reference characters except that they will be within the 400 series.

More particularly, it is seen that the primary significant differences between the third and fourth embodiments of the exhaust check valve and piston return systems 300,400 resides in the fact that in accordance with the principles and teachings of the fourth embodiment exhaust check valve and piston return system 400, the storage plenum chamber 472 has an inlet check valve 478 operatively associated with the fluid passageway 480 fluidically connecting the vent port 432 to the storage plenum chamber 472. Accordingly, after the working air, disposed beneath the piston 404, is forced into the storage plenum chamber 472 as a result of the down stroke or power stroke of the piston 404, the compressed air disposed within the storage plenum chamber 472 will not be released back into the working chamber 408, but to the contrary, will be conducted into the combustion chamber 406 so as to serve as scavenging air, to provide air for the air-fuel mixture to be charged into the combustion chamber 406, and the like. The storage plenum chamber 472 has an outlet fluid passageway 482 fluidically connected thereto, and a control valve mechanism 484 is operatively connected to the outlet fluid passageway 482. In addition, an inlet fluid passageway 486 is interposed between the control valve mechanism 484 and the combustion chamber 406, and accordingly, the control valve mechanism 484 will control the flow of air from the storage plenum chamber 472 into the combustion chamber 406.

The control valve mechanism 484 can be connected, for example, to the trigger mechanism, not shown, of the fastener-driving tool, so as to permit scavenging air, or air for the air-fuel mixture to be charged into the combustion chamber 406, to in fact flow into the combustion chamber 406. If in fact the storage plenum chamber 472 is to be used to conduct an air-fuel mixture toward the combustion chamber 406, through means of the outlet fluid passageway 482, the control valve mechanism 484, and the inlet fluid passageway 486, a fuel injector 488 can be fluidically connected to the storage plenum chamber 472 so as to inject a predetermined amount of fuel into the storage plenum chamber 472 in order to mix with the air charged into and stored within the storage plenum chamber 472 from the working chamber 408. The air-fuel mixture can then, of course, be conducted into the outlet fluid passageway 482, through the control valve mechanism 484 when the control valve mechanism 484 is effectively disposed at its open position, through the inlet fluid passage-way 486, and into the combustion chamber 406. It will lastly be noted that the orifice 450, through which the back-flow fluid within the signal line 446 would normally pass back into the working chamber 408, is not in fact fluidically connected to the signal line 446 on its downstream side or end as viewed or considered in the fluid backflow direction. To the contrary, the downstream side or end is connected to a fluid conduit 490 which vents the backflow fluid to the atmosphere. In this manner, if so desired, only clean air, without any combustion products, will always be present within the working chamber 408.

Figure 11:
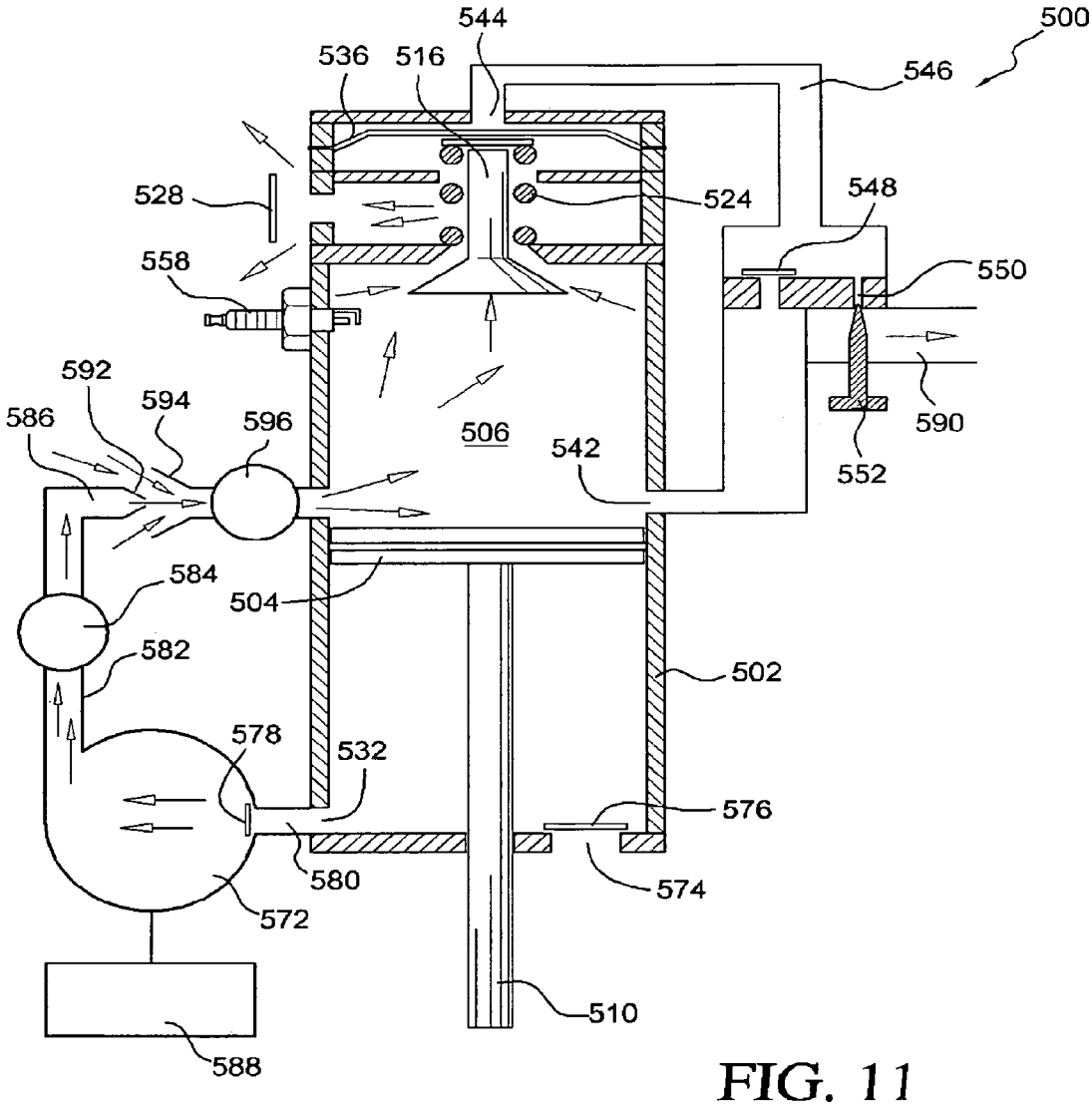
FIG. 11 is a schematic view of a fifth embodiment exhaust check valve and piston return system, similar to the fourth embodiment exhaust check valve and piston return system as disclosed within FIG. 10, wherein, however, a venturi has been incorporated within the conduit, connecting the storage plenum chamber to the combustion chamber, so as to entrain additional scavenging air, or air for the air-fuel mixture, into the combustion chamber.

With reference lastly being made to FIG. 11, a fifth embodiment of a new and improved exhaust check valve and piston return system, for use, for example, in connection with the combustion chamber of a fastener-driving tool, is disclosed and is generally indicated by the reference character 500. In view of the basic similarities of the fifth embodiment exhaust check valve and piston return system 500, with respect to the fourth embodiment exhaust check valve and piston return system 400 as disclosed within FIG. 10, a detailed description of the entire fifth embodiment exhaust check valve and piston return system 500 will be omitted herefrom for brevity purposes, and in lieu thereof, the description of the fifth embodiment exhaust check valve and piston return system 500 will focus upon the differences between the fourth and fifth embodiments of the exhaust check valve and piston return systems 400,500. In addition, it is to be noted that component parts of the fifth embodiment exhaust check valve and piston return system 500, which correspond to components parts of the fourth embodiment exhaust check valve and piston return system 400, will be designated by corresponding reference characters except that they will be within the 500 series.

More particularly, it is seen that the several significant differences exist between the fifth embodiment exhaust valve and piston return system 500, and the fourth embodiment exhaust valve and piston return system 400. Firstly, for example, it is seen that in lieu of the inlet fluid passageway 586 being fluidically connected directly to the combustion chamber 506, the downstream end portion of the inlet fluid passageway 586 terminates in an orifice or nozzle 592, and the orifice or nozzle 592 discharges its fluid contents into a venturi structure 594 such that additional ambient scavenging air can effectively be entrained into the fluid flow being discharged from the inlet fluid passageway 586 whereby an enhanced amount of scavenging air is able to be conducted toward and into the combustion chamber 506. This is because the orifice 592 and venturi structure 594 effectively convert the high pressure, relatively low volume air disposed within the storage plenum chamber 572 into a lower pressure, higher volume air stream so as to more completely or thoroughly scavenge the exhaust gases out from the combustion chamber 506. In addition, a second control valve mechanism 596 is effectively interposed between the venturi structure 594 and the combustion chamber 506 so as to effectively prevent backflow through the venturi structure 594. As was the case with the control valve mechanism 484 of the fourth embodiment exhaust valve and piston return system 400 as disclosed within FIG. 10, both the first and second control valve mechanisms 584 and 596 can be operatively connected to the trigger mechanism, not shown, of the fastener-driving tool.

Continuing further, a second significant difference between the fifth embodiment exhaust valve and piston return system 500, and the fourth embodiment exhaust valve and piston return system 400, resides in the fact that the first signal port 542 is defined within a side wall portion of the cylinder housing 502 which is at a higher elevation, with respect to the combustion chamber 506 and the piston 504, than the first signal ports of the previous embodiments. In this manner, in lieu of normally waiting, for example, for the combustion products from the combustion chamber to enter the signal line as a result of the passage of the piston beneath the first signal port when the piston reaches the end of its down stroke or power stroke and is disposed at its lowermost position, as has been illustrated in accordance with the previous embodiments of the exhaust valve and piston return systems of the present invention, in accordance with the principles and teachings of this fifth embodiment exhaust valve and piston return system 500, combustion products from the combustion chamber 506 can enter the signal line 546, through means of the first signal port 542, in a much shorter period of time subsequent to combustion initiation. This permits a quicker actuation or faster operation of the main exhaust valve 516 while still providing sufficient pressure and force to drive the piston 504 through its complete down stroke or power stroke.

Thus, it may be seen that in accordance with the principles and teachings of the present invention, there has been disclosed a new and improved exhaust check valve and piston return system wherein the main exhaust valve is opened by means of combustion products from the combustion chamber being routed through a signal line. In addition, as a result of the opening of the main exhaust valve, an exhaust check valve, incorporated within a side wall portion of the cylinder housing at a location disposed above the combustion chamber, is likewise forced to its open position so as to permit the hot combustion gases to in fact be exhausted from the combustion chamber, thereby permitting the piston to move upwardly so as to in fact complete its return stroke. The rapid exhaust of the combustion products out from the combustion chamber also serves to effectively cool the tool as a result of the combustion gases not being trapped within the combustion chamber for an inordinate amount of time.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patents of the United States of America, is:

1. An exhaust valve and piston return system for a combustion-powered tool, comprising:

a cylinder housing;

a piston disposed within said cylinder housing;

a combustion chamber defined within said cylinder housing for combusting an air-fuel mixture so as to drive said piston through a power stroke;

a main exhaust valve operatively associated with said combustion chamber for permitting exhaust gases to be exhausted from said combustion chamber;

an exhaust check valve operatively associated with said main exhaust valve for permitting said exhaust gases to be vented to atmosphere as a result of passing through said main exhaust valve and then through said exhaust check valve; and a signal line fluidically connecting said cylinder housing to said main exhaust valve so as to permit said exhaust gases from said combustion chamber to be conducted toward said main exhaust valve so as to move said main exhaust valve to its open position in order to permit said exhaust gases, disposed within said combustion chamber, to be exhausted out from said combustion chamber, and through said main exhaust valve and said exhaust check valve to atmosphere, and to permit said piston to be returned from a position defined at the end of its power stroke to its original position prior to said combustion of said air-fuel mixture within said combustion chamber.

2. The exhaust valve and piston return system as set forth in claim 1, further comprising:

a biasing spring operatively associated with said main exhaust valve for normally biasing said main exhaust valve to a closed position from which said main exhaust valve will be moved to said open position by said exhaust gases conducted from said combustion chamber and toward said main exhaust valve by said signal line.

3. The exhaust valve and piston return system as set forth in claim 1, further comprising:

a diaphragm operatively associated with said main exhaust valve, and upon which said exhaust gases, from said combustion chamber and said signal line, act so as to move said main exhaust valve from said closed position to said open position.

4. The exhaust valve and piston return system as set forth in claim 1, further comprising:

a check valve disposed within said signal line for permitting said exhaust gases to be transmitted from said combustion chamber to said main exhaust valve but preventing said exhaust gases to be transmitted from said main exhaust valve back to said combustion chamber.

5. The exhaust valve and piston return system as set forth in claim 1, further comprising:

a bleed orifice disposed within said signal line for permitting said exhaust gases to be transmitted from said main exhaust valve back to said cylinder housing in order to assist said return movement of said piston back to said original position.

6. The exhaust valve and piston return system as set forth in claim 5, further comprising:

an orifice adjuster operatively associated with said bleed orifice so as to adjustably control the flow of said exhaust gases from said main exhaust valve back to said cylinder housing in order to control the time required to move said main exhaust valve from said open position to said closed position.

7. The exhaust valve and piston return system as set forth in claim 1, wherein:

said signal line is fluidically connected to said cylinder housing by a signal port which is defined within a side wall portion of said cylinder housing which is disposed adjacent to said position at which said piston is disposed when said piston is disposed at the end of its power stroke so as to permit said combustion chamber to be fluidically connected to said signal line, by said signal port, when said piston is disposed at the end of its power stroke.

8. The exhaust valve and piston return system as set forth in claim 7, wherein:

said signal line is fluidically connected to a working chamber, which is defined upon a side of said piston which is disposed opposite the side of said piston which is exposed to said combustion chamber, so as to permit said exhaust gases, being transmitted by said signal line from said main exhaust valve to said working chamber, to assist the return of said piston from the end of its power stroke back to its original position.

9. The exhaust valve and piston return system as set forth in claim 8, further comprising:

a check valve disposed within said signal line for permitting said exhaust gases to be transmitted from said combustion chamber to said main exhaust valve but preventing said exhaust gases to be transmitted from said main exhaust valve back to said combustion chamber.

10. The exhaust valve and piston return system as set forth in claim 9, further comprising:

a bleed orifice having an upstream end portion thereof disposed within said signal line for receiving said exhaust gases being transmitted from said main exhaust valve back toward said cylinder housing, but having a downstream end portion thereof vented to atmosphere such that only fresh ambient air is present within said working chamber.

11. The exhaust valve and piston return system as set forth in claim 10, further comprising:

an orifice adjuster operatively associated with said bleed orifice so as to adjustably control the flow of said exhaust gases from said main exhaust valve back to atmosphere in order to control the time required to move said main exhaust valve from said open position to said closed position.

12. The exhaust valve and piston return system as set forth in claim 8, further comprising:

a vent port fluidically connecting said working chamber to atmosphere for permitting fluid, disposed within said working chamber, to be vented from said working chamber to atmosphere when said piston is being moved from its original position toward said end of its power stroke, and for permitting ambient air to enter said working chamber when said piston is being moved from said end of its power stroke back to its original position.

13. The exhaust valve and piston return system as set forth in claim 1, further comprising:

a partition wall disposed within said combustion chamber so as to effectively divide said combustion chamber into first and second combustion chambers; and a control valve is operatively associated with said partition wall so as to control the flow of combustion products from said first combustion chamber into said second combustion chamber.

14. The exhaust valve and piston return system as set forth in claim 13, further comprising:

a biasing spring operatively associated with said control valve for normally biasing said control valve to a closed position from which said control valve will be moved to its open position by the pressure of said combustion products disposed within said first combustion chamber.

15. The exhaust valve and piston return system as set forth in claim 8, further comprising:

an inlet port fluidically connecting said working chamber to atmosphere so as to permit ambient air to enter said working chamber when said piston is being moved from the end of its power stroke to its original position so as to assist the movement of said piston from the end of its power stroke back to its original position;

a check valve operatively associated with said inlet port for preventing fluid, disposed within said working chamber, from being vented to atmosphere when said piston is being moved from its original position to the end of its power stroke; and a storage plenum chamber for receiving, accumulating, and storing fluid, disposed within said working chamber, when said piston is moved from its original position to the end of its power stroke, whereby such accumulated and stored fluid can be conducted from said storage plenum chamber back into said working chamber in order to assist the movement of said piston from the end of its power stroke back to its original position.

16. The exhaust valve and piston return system as set forth in claim 15, further comprising:

a check valve operatively associated with said storage plenum chamber for permitting said fluid, disposed within said working chamber, to enter said storage plenum chamber but preventing said fluid, disposed within said storage plenum chamber from being returned to said working chamber; and a fluid passageway for fluidically connecting said storage plenum chamber to said combustion chamber for permitting said fluid, disposed within said storage plenum chamber, to be discharged into said combustion chamber so as to scavenge exhaust gases out from said combustion chamber.

17. The exhaust valve and piston return system as set forth in claim 16, further comprising:

a valve, disposed within said fluid passageway, for controlling the discharge of said fluid from said storage plenum chamber into said combustion chamber.

18. The exhaust valve and piston return system as set forth in claim 16, further comprising:

a fuel injector fluidically connected to said storage plenum chamber for injecting fuel into said storage plenum chamber in order to form an air-fuel mixture within said storage plenum chamber which can then be transmitted into said combustion chamber.

19. The exhaust valve and piston return system as set forth in claim 16, further comprising:

a venturi, operatively associated with said fluid passageway, for entraining ambient air into said fluid passageway so as to enhance the amount of scavenging air conducted into said combustion chamber.

20. The exhaust valve and piston return system as set forth in claim 19, further comprising:

a valve, disposed within said fluid passageway, for controlling the discharge of said fluid from said storage plenum chamber into said combustion chamber and for preventing backflow from said combustion chamber into said venturi.

* * * * *